United States Patent [19]

Begnaud et al.

[11] 4,166,569

[45] Sep. 4, 1979

[54] CONTAINER

[75] Inventors: Edward M. Begnaud, Bay Village; Benedict C. Birkmeier, Strongsville, both of Ohio

[73] Assignee: The B. F. Goodrich Company, Akron, Ohio

[21] Appl. No.: 881,228

[22] Filed: Feb. 27, 1978

[51] Int. Cl.[2] ..... B65D 5/32; B65D 5/44; B65D 5/56

[52] U.S. Cl. ..... 229/23 C; 206/386; 220/441; 220/463; 229/17 B; 229/49

[58] Field of Search ..... 108/55-56; 206/83.5, 386, 597, 600; 217/3 R, 3 BC, 3 CV; 220/415, 441, 460, 463; 229/23 C, 49, 50

[56] References Cited

U.S. PATENT DOCUMENTS

| | | | |
|---|---|---|---|
| 1,044,667 | 11/1912 | Lachman | 220/83 |
| 3,079,060 | 2/1963 | Cherrin | 220/441 |
| 3,921,892 | 11/1975 | Macie | 206/386 X |
| 4,087,041 | 5/1978 | Centanni | 220/441 |

FOREIGN PATENT DOCUMENTS

| | | | |
|---|---|---|---|
| 2550009 | 5/1976 | Fed. Rep. of Germany | 206/386 |
| 1387409 | 3/1975 | United Kingdom | 206/597 |

*Primary Examiner*—Stephen Marcus
*Attorney, Agent, or Firm*—Joseph Januszkiewicz

[57] ABSTRACT

A container for the storing and shipping of a flowable material and more particularly baled rubber wherein the container has an inner corrugated paperboard liner supported on two sides by separate rigid frame members, each frame member having interconnected cross braces. An outer shell made of corrugated paperboard encompasses the bottom and respective sides of the liner and frame members. The shell has straps internally thereof encompassing the container to cooperate with the rigid side frame members to provide support for the container. Such container may be covered with a plastic cover or a flat corrugated sheet of material. Alternatively, a cap or lid may be made to encompass a portion of the upper end of the outer shell to enclose all material within the container. The container is attached to a pallet to form an integral unit.

8 Claims, 4 Drawing Figures

CONTAINER

BACKGROUND OF THE INVENTION

This invention relates generally to the field of containers and more particularly to a reinforced container for shipping bulk materials such as rubber and other flowable materials, wherein the containers may be stacked and moved by machinery such as a fork lift truck.

In the shipping of raw synthetic rubber from the source of manufacture or production to the particular place of use, considerable handling of the material is involved. The ability to repeatably stack packages of baled flowable material such as rubber from transfer point to transfer point and final destination is limited because of their inability to withstand the constant stacking and transfer to maintain their integrity and shape. The present invention is concerned with a new container that permits the packaging of raw or artificial rubber, maintain its integrity in shipping, storing, and handling. Containers of the instant invention can carry materials that weigh over 2000 pounds.

SUMMARY OF THE INVENTION

The present invention is directed to a container for packaging a yieldable mass such as synthetic rubber for storage and shipping, wherein the container can be moved easily as by a fork lift truck. The container has an inner liner, two oppositely disposed frame members that permit stacking, an outer shell enclosure which has internally therein straps or bands that extend peripherally therethrough, enclosing the entire container. Such straps or bands cooperate with the frame members to provide rigidity to the container. A top cap and pallet may be incorporated into the container to provide an integral unit that permits stacking, repeated handling, and is economic to ship and load.

BACKGROUND OF THE INVENTION

Figure 1:
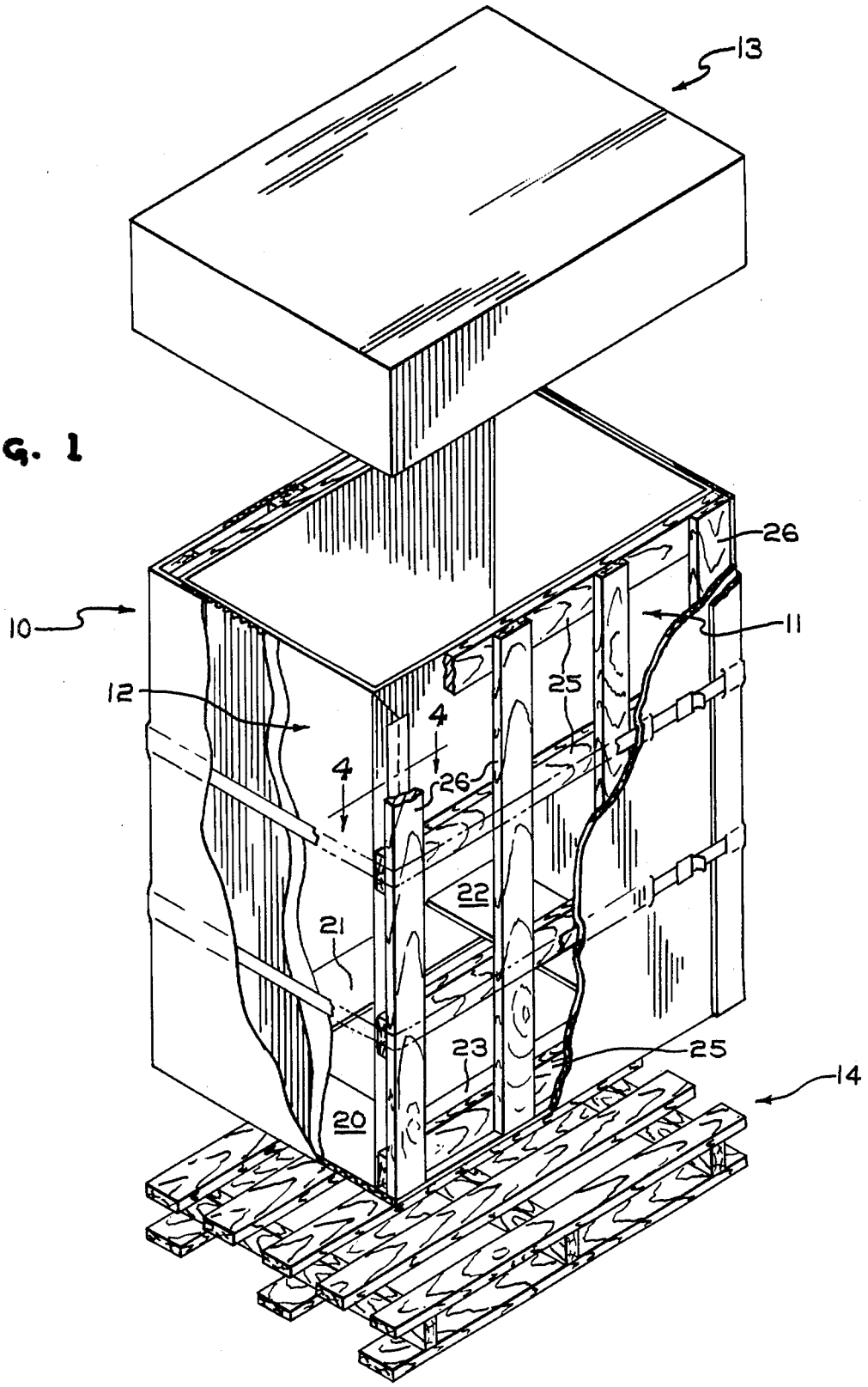
FIG. 1 is an isometric view of the container with the cap removed and a portion of the container walls broken away to disclose straps, frame members, and inner liner.
Figure 2:
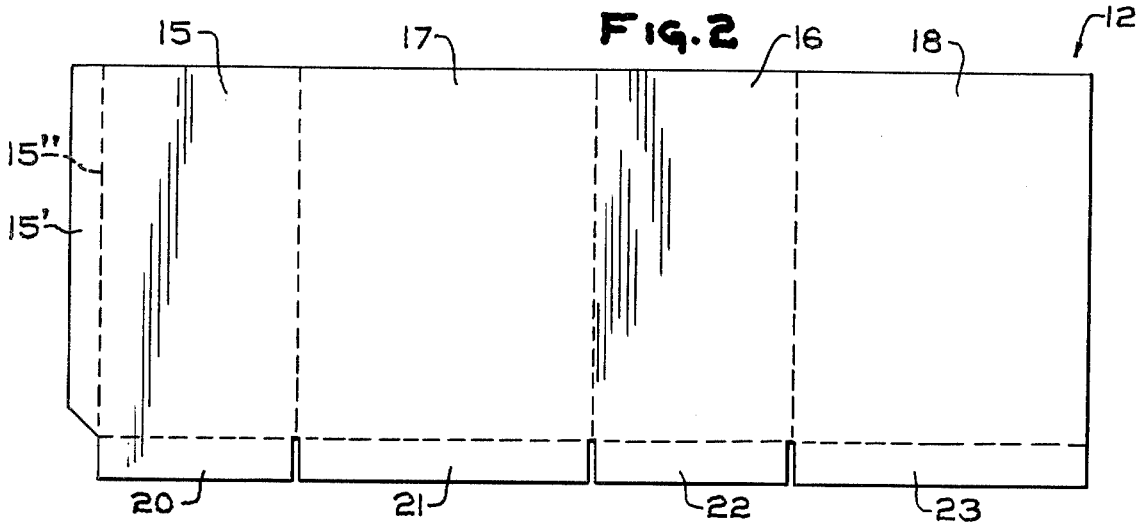
FIG. 2 is a side elevational view of the inner liner in a flattened condition showing the various panels.

Referring now to the drawings, there is shown a container with an outer corrugated paperboard shell or cover 10, two side frames 11, an inner corrugated paperboard liner 12, a cap 13, and a pallet 14.

Figure 4:
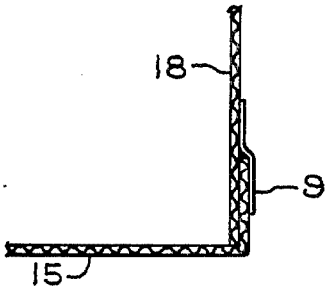
FIG. 4 is an enlarged fragmentary plan view of one corner portion of the inner liner.

The inner liner 12 is an elongated, rectangular-shaped corrugated sheet or panel of paperboard with two end panels 15, 16, two side panels 17, 18, and flaps 20, 21, 22, and 23 that are connected to panels 15, 17, 16, and 18 respectively. The flaps 20–23 extend outwardly from the respective panels 15–18. The juncture between the respective panels 15, 16, 17, and 18 are scored to facilitate the folding of the rectangular-shaped corrugated sheet into an open boxlike container. The juncture between the respective flaps 20–23 and their adjacent respective panels 15 through 18 are scored to permit the folding of flaps flags to form the bottom of the container. Panel 15 has an elongated tab 15' extending laterally outwardly from the panel section thereof and scored along the juncture as indicated by the numeral 15''. The tab 15' is folded over the edge of the adjacent panel 18 to provide an integral unit to facilitate handling of the boxlike unit for filling. An elongated strip of tape 9 is used to fasten or secure the respective side panels 15 and 18 together by having its elongated center overlie the juncture of panel 18 and the tab 15' as shown in FIG. 4. In lieu of the tape 9, panel 18 can be glued to panel 15 by gluing tab 15' to panel 18. The purpose of the tape is to facilitate the assembling of the container, and that after filling of the assembled container with the bales of rubber, the tape bond will break under stress allowing the inner liner to expand so that the stress is distributed and taken up by the side frames 11 and the outer liner with its straps to be described.

Abuttingly engaging the respective panels 17 and 18 are side frames or supports 11 (FIG. 1) which provide rigidity to the structure and permits stacking of the containers. Each side support 11 includes a plurality of horizontally extending braces 25 with one of such braces located at the very bottom of the container, and one of such braces 25 being located at the very top of such container. A plurality of vertically extending braces 26 interconnect the horizontal braces 25 as by nailing or gluing. There is one of such braces 26 at the respective corners of the side frames 11. Braces 25 and 26 can be made of wood or other suitable rigid material.

Figure 3:
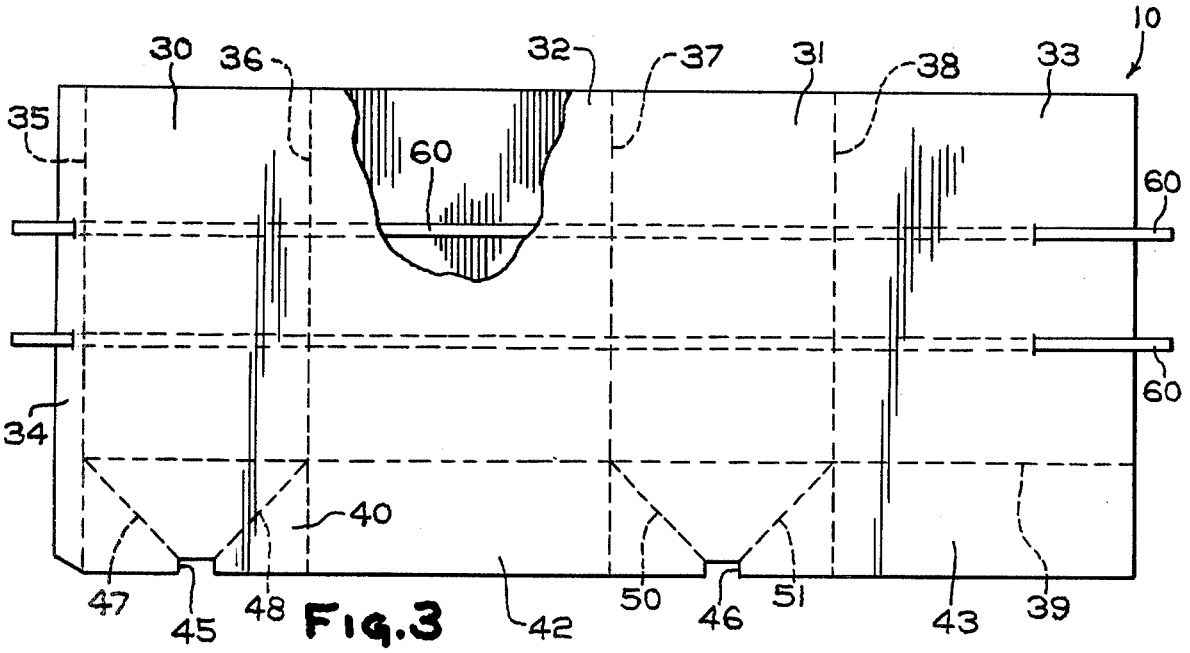
FIG. 3 is a side elevational view of the outer shell in a flattened condition.

The outer shell 10 is an elongated, rectangular-shaped corrugated sheet of paperboard with two end panels 30, 31, and two side panels 32, 33, and an end tab 34. The junctures between the respective panels 30 through 33 and tab 34 with panel 30 are scored to facilitate the folding of the rectangular-shaped corrugated sheet into an open boxlike container. The score line between tab 34 and panel 30 is indicated as 35. The score lines between panels 30–32, 32–31, and 31–33 are score lines 36, 37, and 38 respectively. The lower portion of each panel 30, 31, 32, and 33 is scored as viewed in FIG. 3 along a horizontal score line 39 to provide lower panels 40, 41, 42, and 43 respectively, which lower panels 40, 41, 42, and 43 will be folded along such horizontal score line 39 to extend such lower panels at right angles to panels 30, 31, 32, and 33 when the outer shell is assembled for use.

The lower panels 40 and 41 are notched at their lower intermediate edge portions as at 45 and 46. In addition, panel 40 has a pair or diverging score lines 47 and 48 that extend from the notch 45 to the respective corners thereof. Score line 47 extends from the intersection of score line 39 and 35 to an edge of notch 45 while score line 48 extends from the intersection of score lines 39 and 36 to an edge of notch 45. Panel 41 has a pair of score lines 50 and 51. Score line 50 extends from the intersection of score lines 39 and 37 to an edge of notch 46 while score line 51 extends from the intersection of score lines 39 and 38 to an edge of notch 46. On assembling such outer shell 10 the score lines in the lower panels permit the folding thereof into a flat support member, with the notches 45 and 46 relieving the bulk or buildup of material. The tab 34 is secured to the panel 33 when the outer shell 10 is formed into the boxlike structure.

The outer shell 10 has a pair of straps or bands 60 (which may be metal) disposed therein between the corrugations 61 (FIG. 1) and the linerboard of the outer shell 10. The ends of straps 60 in outer shell 10 near the corner of one end panel normally referred to as the manufacturer's joint as shown in FIG. 1 must be sealed to prevent expansion or bursting of the outer corrugated shell 10. Although two straps are shown, it is contemplated to have at least one strap to maintain the integrity of the container whereas additional straps are contemplated to provide a means to prevent bulging or rupturing of the container.

Although metal straps are shown in this embodiment, it is contemplated to also use any banding material with sufficient tensile strength to resist elongation when placed under tension and sufficient tear strength to resist breakage. One unique aspect of the straps in the outer shell 10 of the instant invention is that they restrain or hold the frames 11 in position resulting in a package design that restricts and controls flowable products in the container package. The straps 60 are sealed prior to use to facilitate the assembling of the container. Where the straps 60 are made of metal, the straps are fastened together in a closed loop by any suitable means. Where the straps are made of plastic or other similar material, wire staples can be driven through the straps and the corrugated liner to provide a means for securing straps 60 into a closed loop of predetermined length. The straps or banding material 60 may be glued or otherwise adhered between the corrugated medium and the linerboard around the perimeter of the shell providing the closed loop of predetermined length. When the container is to be loaded, the bales of rubber are stacked into the inner liner 12 which has been preassembled with the respective side supports 11 abuttingly engaging their respective side panels and the outer shell 10 encompassing the side supports 11 and the inner liner 12. The container, under the stress of the loaded mass, will exert an outward force on the inner liner 12 and at most cause the rupturing of the tape 9 along the steam between tab 15' and panel 18. The outward stress of the material within the inner liner 12 is taken up by the two side supports 11 and the straps 60 encompassing the outer shell 10, the side supports 11, and the inner liner 12 to maintain the integrity of the container.

A cap 13 made of material, in this instance corrugated paperboard, is placed over the upper end of outer shell 10, although such container does not require such cap since such cap is not necessary to the structural strength of the container, such cap or cover prevents contamination of the material therein. Such cover may be a plastic or a polyethylene bag. In lieu of such cover, a flat corrugated sheet may be placed over the top of the container. A pallet 14 is glued or otherwise secured to the bottom surface of the outer shell 10.

It will be apparent, although a specific embodiment and certain modifications of the invention have been described in detail, the invention is not limited to the specifically illustrated and described constructions since variations may be made without departing from the principles of the invention.

We claim,

1. A container for the storing and shipping of flowable material comprising an inner corrugated liner for confining the material into a rectangular-shaped mass; said liner having two end panels and two side panels, each of said side panels having a pair of vertically extending corner edges, a top horizontally extending edge and a bottom edge; a rigid side frame member abuttingly engaging each of said side panels; each side frame having at least one brace along each of said edges of said side panels; the braces in each of said respective side frames being interconnected to provide two separate rigid support means; an outer shell encompassing said side frames and said liner; said shell having a bottom surface; said shell having straps disposed internally thereof and extending horizontally around said shell forming support means for said shell; and said straps defining a closed loop of predetermined length.

2. A container for the storing and shipping of flowable material as set forth in claim 1 wherein said inner corrugated liner has a breakaway joint to position said inner liner into full contact with said side frames and said outer shell.

3. A container for the storing and shipping of flowable material as set forth in claim 2 wherein said outer shell comprises an inner corrugated liner and an outer linerboard; and said closed loop straps are located between said inner corrugated liner and said outer linerboard.

4. A container for the storing and shipping of flowable material as set forth in claim 3 wherein a cover is positioned over the upper end of said shell to form an integral unit therewith.

5. A container for the storing and shipping of rubber comprising an inner corrugated liner for the confining of a flowable mass into a rectangular-shaped mass; said liner having two end panels and two side panels; one of said end panels having a tab to secure said one end panel to an adjacent one of said side panels; each of said panels having an end flap extending outwardly therefrom to overlap each other to form a base for supporting material confined within said inner liner; each of said side panels having a rigid side frame abuttingly engaging the outer surface thereof; an outer shell encompassing said side frames and said inner liner to form an integral unit; said shell having a top open end and a closed bottom end; said bottom end of said outer shell supporting and engaging said base of said inner liner; said shell having straps disposed internally thereof and encompassing said side frames and said inner liner with said outer shell; said straps forming closed loops of predetermined length to support said side frame members and reinforce said outer shell; and a cover positioned over the top end of said shell to form an integral unit therewith.

6. A container as set forth in claim 5 wherein a tape secures one of said end panels to an adjacent one of said side panels to form a breakaway joint.

7. A container as set forth in claim 6 wherein said strap is a metal band circumferentially encompassing said container.

8. A container as set forth in claim 6 wherein staples secure said straps into said loop of predetermined length.

* * * * *